US006772741B1

(12) United States Patent
Pittel et al.

(10) Patent No.: US 6,772,741 B1
(45) Date of Patent: Aug. 10, 2004

(54) HIGH VACUUM PURGE ARRANGEMENT FOR VAPOR CANISTERS

(75) Inventors: Alan T. Pittel, Hartland, MI (US); Ann Weimer, Waynesville, OH (US); Chris G. Hadre, LaSalle (CA)

(73) Assignees: DaimlerChrysler Corporation, Auburn Hills, MI (US); Behr America, Inc., Troy, MI (US)

( * ) Notice: Subject to any disclaimer, the term of this patent is extended or adjusted under 35 U.S.C. 154(b) by 0 days.

(21) Appl. No.: 10/446,513

(22) Filed: May 28, 2003

(51) Int. Cl.[7] ..... F02M 25/08

(52) U.S. Cl. ..... 123/519; 123/520; 96/109; 96/143

(58) Field of Search ..... 123/516, 518, 123/519, 520; 96/109, 143

(56) References Cited

U.S. PATENT DOCUMENTS 5,398,660 A * 3/1995 Koyama et al. ..... 123/519
5,456,236 A * 10/1995 Wakashiro et al. ..... 123/519
6,230,693 B1 * 5/2001 Meiller et al. ..... 123/519
6,564,779 B2 * 5/2003 Sugimoto et al. ..... 123/520

* cited by examiner

*Primary Examiner*—Weilun Lo
(74) *Attorney, Agent, or Firm*—Donald J. Wallace

(57) ABSTRACT

A vapor recovery canister is provided and includes an inlet port, an outlet port, and a first and second valve. The first and second valves are operable to restrict fluid flow into the canister, whereby the first valve is operable to selectively close the inlet port and the second valve is operable to selectively close the outlet port. In addition, the second valve includes at least one orifice formed therethrough for continuous fluid communication with an ambient air stream. In this manner, if both the first and second valves are in a closed position, an ambient air stream will be in fluid communication with an interior volume of the canister during a purging process through interaction of the orifice. The interaction of the orifice causes a high vacuum pressure within the canister, thereby increasing working capacity and reducing diurnal breathing loss.

20 Claims, 4 Drawing Sheets

HIGH VACUUM PURGE ARRANGEMENT FOR VAPOR CANISTERS

FIELD OF THE INVENTION

The present invention relates to vapor recovery canisters, and more particularly, to an improved vapor recovery canister for use in a fuel system.

BACKGROUND OF THE INVENTION

Vapor recovery canisters serve to trap fuel vapor displaced during vehicle refueling operations as well as those created through a diurnal breathing loss (natural heating and cooling cycles). Specifically, vapor recovery canisters are in fluid communication with a fuel tank such that as pressure builds up in the tank caused by entering fuel or through a diurnal event, displaced fuel vapor disposed within the tank, will be treated prior to expulsion into the atmosphere. In this manner, the vapor recovery canister typically includes an adsorbent material, whereby the adsorbent material is operable to trap and store fuel vapor for future use. Once the adsorbent material has cleansed the air stream, and has sufficiently trapped the fuel vapor, the air stream may be released into the atmosphere.

After cleansing the air stream, the adsorbent material is loaded with fuel vapor which may be reused during the combustion process of a vehicle engine by purging the vapor recovery canister. In this regard, a conventional vapor recovery canister serves to cleanse a vapor laden air stream, thereby reducing fuel vapor emissions to the atmosphere. In addition, the vapor canister stores hydrocarbons from the captured fuel vapor for use in the combustion process of the engine, thereby improving the overall efficiency of the vehicle.

While adequately capturing fuel vapor from an air stream, a conventional vapor recovery canister suffers from the disadvantage of requiring a free flow into and out of the canister to ensure that the fuel tank can breathe freely during the purge cycle. In this regard, conventional vapor recovery canisters sacrifice a vacuum pressure, thereby reducing their efficiency. Therefore, a vapor canister that is exposed to a high vacuum during a purge cycle, thereby improving the working capacity of the canister, is desirable in the industry. Further, a vapor recovery canister which allows a fuel tank to maintain a predetermined pressure during a purging cycle, while concurrently providing an increased vacuum to the canister, is desirable in the industry.

SUMMARY OF THE INVENTION

Accordingly, the present invention provides a vapor recovery canister including an inlet port, an outlet port, and a first and second valve. The first and second valves are operable to restrict vapor flow into the canister, whereby the first valve is operable to selectively close the inlet port and the second valve is operable to selectively close the outlet port. In addition, one of the first or second valves includes at least one orifice formed therethrough for continuous fluid communication with an ambient air stream. In this manner, if either or both of the first and second valves are in a closed position, an air stream will be in fluid communication with an interior volume of the canister through interaction of the orifice, thereby causing the air stream to be in vacuum. By providing the canister with a continuous ambient air stream under high vacuum, the amount of hydrocarbons removed will increase. In this regard, the amount of hydrocarbons adsorbed during a load or purge cycle will increase, thereby reducing diurnal breathing emissions. In this regard, the introduction of high vacuum to the canister, when the first and second valves are in the closed position, increases the overall operation and efficiency of the canister.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
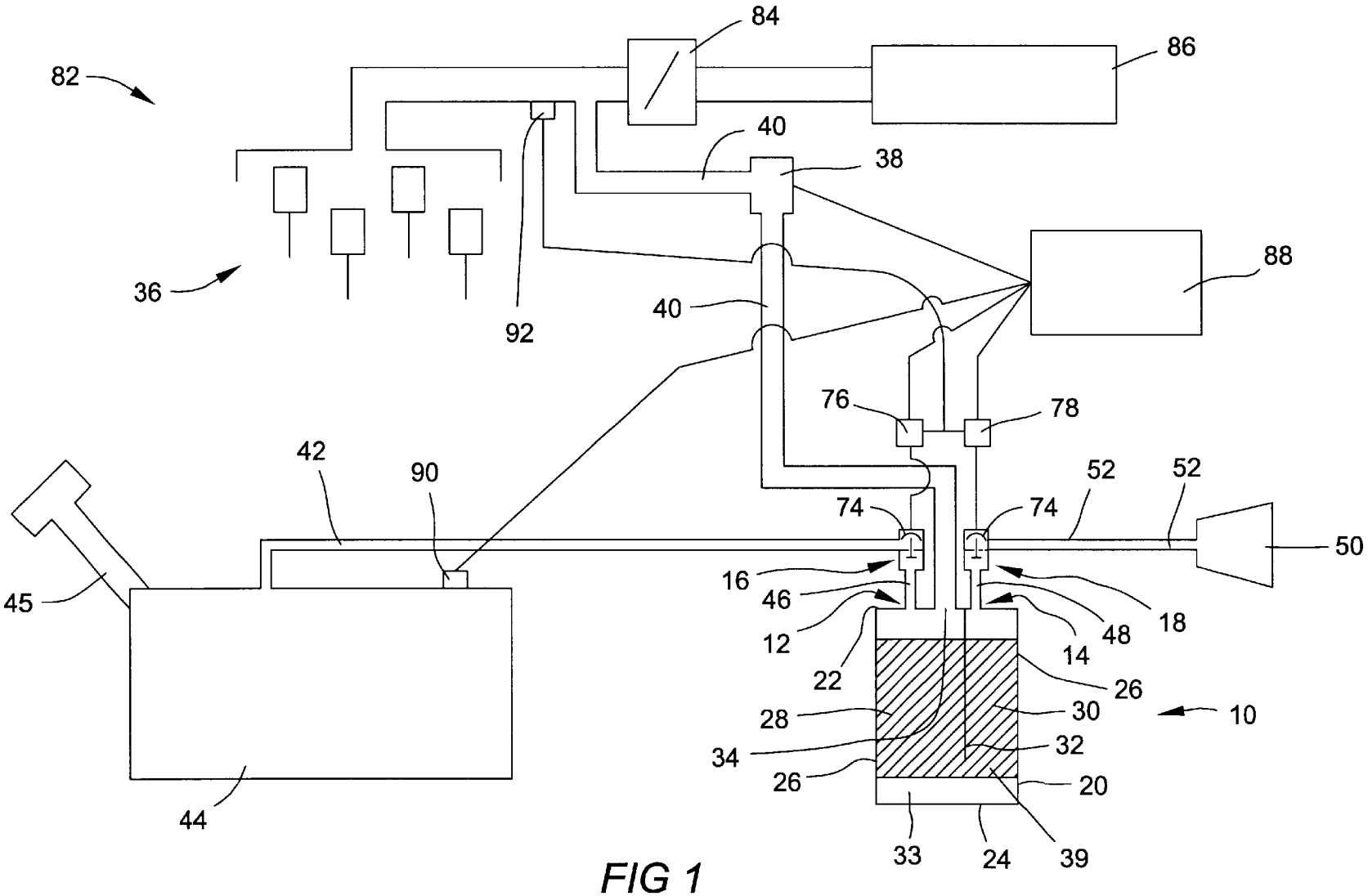
FIG. 1 is a schematic representation of a fuel system having a vapor recovery canister in accordance with the principles of the present invention.

The following description of the preferred embodiments is merely exemplary in nature and is in no way intended to limit the invention, its application, or uses.

With reference to the Figures, a vapor recovery canister 10 is provided and includes an inlet port 12, an outlet port 14, and a first and second valve 16, 18. The first and second valves 16, 18 are operable to open and close the inlet and outlet ports 12, 14 to regulate airflow into and out of the vapor canister 10, as Will be described in more detail below.

The vapor recovery canister 10 includes a housing 20, generally defined by a top panel 22, a bottom panel 24, and a plurality of side panels 26. In addition, the housing 20 includes a first and second compartment 28, 30, whereby an internal wall 32 divides the first and second compartments 28, 30. In this manner, the first and second compartments 28, 30 are generally formed within an interior space 33 of the housing 20, as best shown in FIG. 1.

The inlet port 12 is a substantially circular aperture formed through the top panel 22 and is disposed generally over the first compartment 28. In this manner, the inlet port 12 provides access to the interior space 33 of the housing 20 generally at the first compartment 28. The outlet port 14 is a substantially circular aperture formed through the top panel 22 and is disposed generally over the second compartment 30. In this regard, the outlet port 14 provides access to the interior space 33 of the housing 20 generally at the second compartment 30.

The housing 20 further includes a bed of adsorbent material comprising carbon pellets 39. The adsorbent pellets 39 are operable to filter and store impurities from a vapor laden air stream passing through the housing 20. In this manner, the adsorbent pellets 39 serve to store trapped impurities and cleanse the air stream prior to expelling the air stream from housing 20.

The housing 20 further includes a purge port 34, whereby the purge port 34 is in fluid communication with the interior space of the housing 20. The purge port 34 is a generally circular aperture formed in the top panel 22 of the housing 20 and is generally disposed above the first compartment 28. In addition, the purge port 34 is in fluid communication with a vehicle engine 36 and is operably controlled by a purge solenoid 38, as shown in FIG. 1. Specifically, the purge port 34 is fluidly connected to both the purge solenoid 38 and the vehicle engine 34 by a conduit 40. In this manner, the purge port 34 allows the purge solenoid 38 to draw an air stream through the housing 20 and into the vehicle engine 36 for further combustion, thereby placing the housing 20 under a vacuum pressure when the first and second valves 16, 18 are closed.

To allow a flow of air into the housing 20, the first valve 16 is fluidly coupled to the inlet port 12 at a first end by a first conduit 46 and fluidly coupled to a fuel tank 44 at a second end by a second conduit 42. In this manner, an air stream from the fuel tank 44 may be routed to the first compartment 28 of the canister 10 through the interaction of the first and second conduits 42, 46 and the first valve 16. Specifically, as fuel (not shown) enters the fuel tank 44 through a filler tube 45, displaced fuel vapor is forced into the first conduit 42. Once the fuel vapor has sufficiently traveled along the first conduit 42, the vapor will pass through the first valve 16 and second conduit 46 until finally reaching the first compartment 28. Once the fuel vapor reaches the first compartment 28, the adsorbent pellets 39 are operable to treat the vapor stream and store hydrocarbons prior to releasing the air stream into the atmosphere.

As the fuel vapor passes through the adsorbent pellets 39, the vapor is attracted to a surface of the carbon pellets 39. In this regard, the adsorbent pellets 39 effectively remove and store most, if not all, of the impurities from the air stream for further use in the combustion process while concurrently placing the air stream in a condition to be expelled into the atmosphere without releasing impurities. Once cleansed, the air stream flows from the first compartment 28 to the second compartment 30, and finally out of the housing 20 though the outlet port 14. In this manner, the cleansed air stream flows through a third conduit 48 fluidly attached to the second valve 18, and finally through a filter arrangement 50 via a fourth conduit 52. It should be understood that the filter 50 allows the expelled air to pass therethrough and be released into the atmosphere. In addition, the filter arrangement 50 serves to cleanse an incoming air stream when air is drawn into the canister 10 during the purge cycle, thereby inhibiting impurities from entering the canister 10 during the purging cycle.

Figure 3:
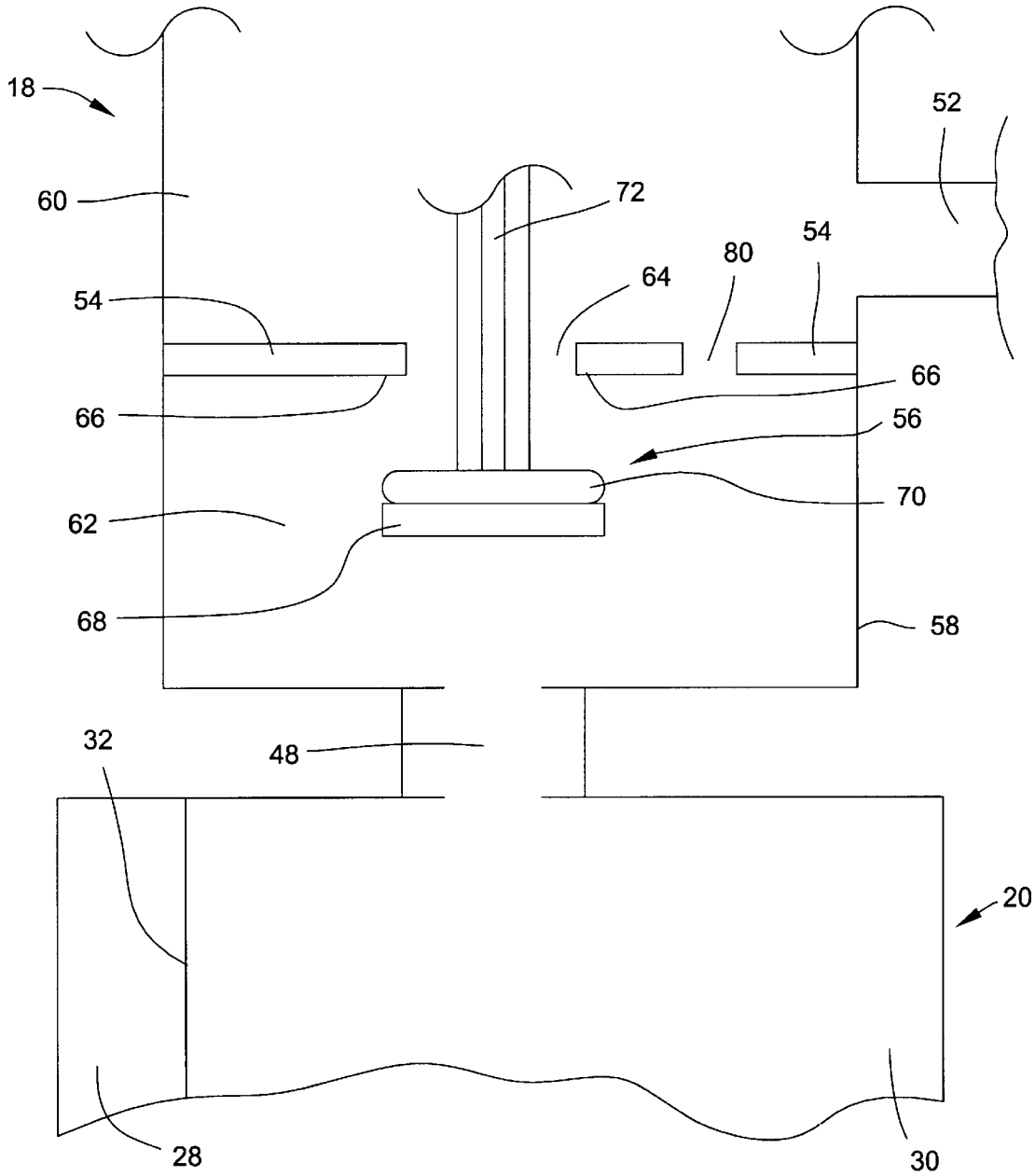
FIG. 3 is a detailed view of a first valve of the vapor recovery canister of FIGS. 1–2.
Figure 4:
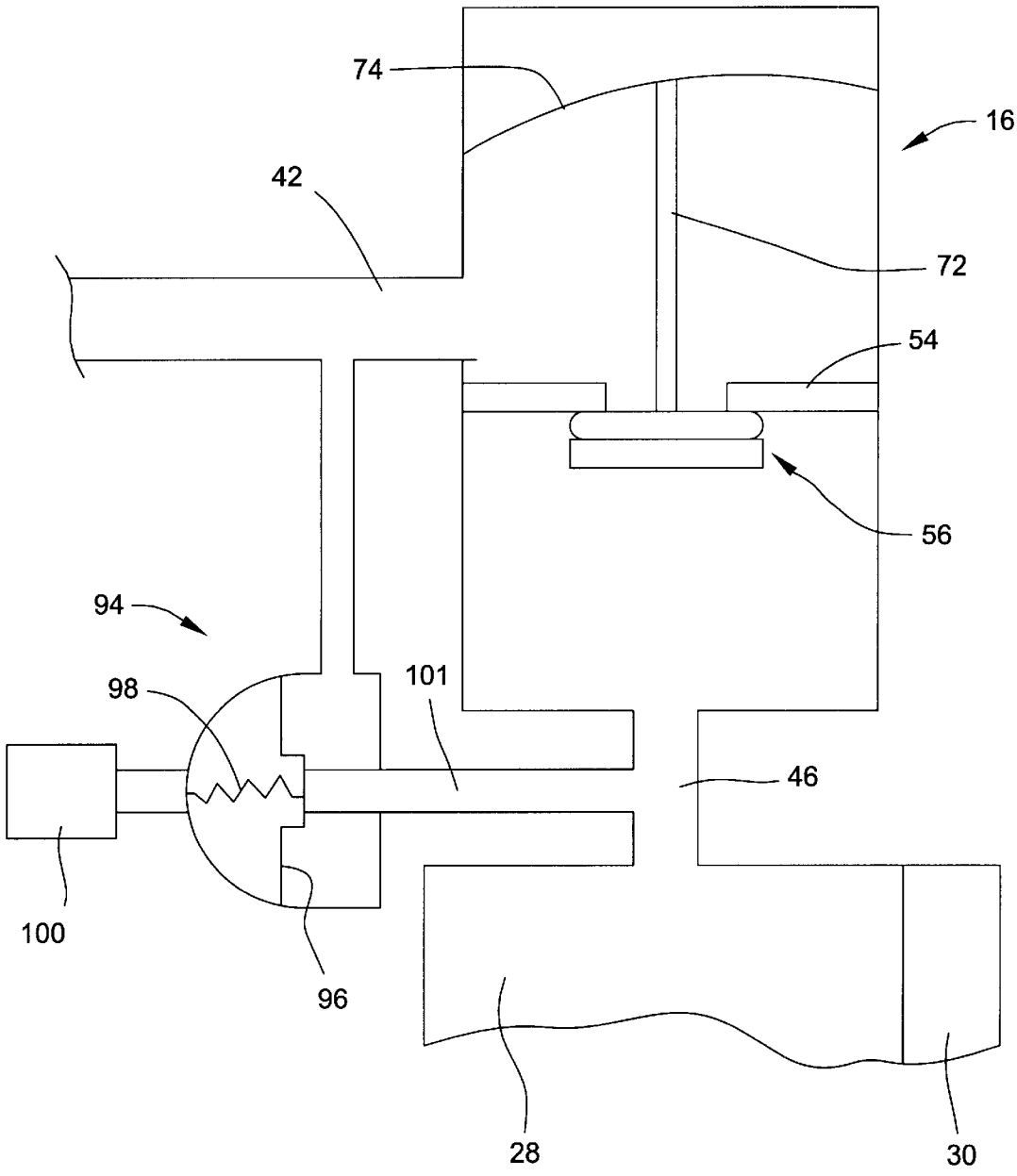
FIG. 4 is a detailed view of a second valve of the vapor recovery canister of FIGS. 1–2 having a pressure regulator mounted thereto.

With reference to FIGS. 3 and 4, the first and second valves 16, 18 are shown in detail. The first and second valves 16, 18 regulate the flow of air into and out of the housing 20 through the interaction between an internal shelf member 54 and a plunger 56 formed within both the first and second valves 16, 18. Specifically, the shelf member 54 is integrally formed with a housing 58, whereby the shelf extends across the housing 58 to form a first and second chamber 60, 62. The shelf 54 includes a central aperture 64 and an engagement surface 66 formed generally within and facing the second chamber 62.

The plunger 56 includes a generally cylindrical body 68 having a sealing member 70 fixedly attached thereon for interaction with the engagement surface 66 of the shelf 54. In addition, the plunger 56 includes an elongate post 72 extending from the cylindrical body 68. The elongate post 72 is received by the aperture 64 of the shelf 54 and translates therein between an open and closed position. In the closed position, the cylindrical body 68 abuts the shelf 54 such that the sealing member 70 effectively seals the first chamber 60 from the second chamber 62 through interaction between the sealing member 70 and the engagement surface 66. In the open position, the cylindrical body 68 is disengaged from the shelf 54, thereby allowing a flow of air to move between the first and second chambers 60, 62 through aperture 64.

The plunger 56 is biased into the open position by a diaphragm 74, whereby the diaphragm 74 serves to maintain the valves 16, 18 in the open position under normal operating conditions, thereby allowing an air flow to freely enter and exit the housing 20. However, when the engine 36 is running, it generates a vacuum that is applied to the back of the diaphragm 74. This moves the plunger 56, closing the first and second valves 16, 18 and inhibiting air flow to the fuel tank 44. Specifically, as a vacuum is applied to the diaphragm 74, the plungers 56 of the first and second valves 16, 18 engage the shelves 54 to isolate fuel tank 44. In this manner, the fuel tank 44 is protected from the vacuum condition generated by engine 36 at the canister 20.

The first and second valves 16, 18 are automatically opened once the vacuum pressure is released from the diaphragm 74. Specifically, once the vacuum air pressure is released, the bias of the diaphragm 74 causes the plunger 56 to disengage the shelf 54, thereby allowing an airflow to once again pass through aperture 64 and flow between the canister 10 and the fuel tank 44. Alternatively, the opening of the valves can be controlled by a first and second valve solenoid 76, 78, whereby the first and second valve solenoids 76, 78 are operable to toggle the plunger 56 between the open and closed states. In this manner, the valve solenoids 76, 78 are operable to control the airflow into and out of the canister 10, as will be discussed further below.

The second valve 18 further includes an orifice 80 formed through the internal shelf 54. Through the orifice 80, the second valve 18 maintains a fluid connection between the outlet port 14 and the housing 20, even when the plunger 56 is in the closed position. The orifice 80 thereby allows a reduced and measured flow of air to enter the housing 20 when the canister 10 is subjected to a vacuum pressure from the engine 36. Specifically, when both the first and second valves 16, 18 are in the closed position, the orifice 80 allows the engine 36 to draw an air flow though the orifice 80. In this manner, as a vacuum is imposed on the canister 10 by the engine 36, the performance of the canister 10 in removing hydrocarbons from the carbon pellets 39 is improved by the continuing flow of air from the atmosphere, through the filter 50 and orifice 80, and through the carbon pellets 39 to the engine 36.

While the orifice 80 has been described as being formed through the internal shelf 54, the orifice 80 could alternatively be formed through the cylindrical body 68 of the second valve 18. In this manner, the orifice 80 similarly provides the second compartment 30 with the ability to be in fluid communication with the atmosphere when first and second valves 16, 18 are in the closed position. For at least the reasons discussed above, providing the plunger 56 with an orifice 80 enables the canister 10 to experience increased air flow when the engine 36 is running, thereby improving the desorption of hydrocarbon, and later, the adsorption of hydrocarbons by the adsorbent pellets 39.

With particular reference to FIG. 1, the vapor recovery canister 10 is shown incorporated into a fuel system 82 having a throttle body 84, an air cleaner 86, and an engine controller 88. As previously described, the vapor recovery canister 10 is fluidly coupled to both a fuel tank 44 and a filter arrangement 50, whereby the filter arrangement 50 serves to clean an air stream received into the canister 10 during the purging cycle and serves to expel a cleansed air stream from the canister 10 when the engine 36 is not running.

Once fuel enters the fuel tank 44, a vapor laden air stream is caused to enter the first chamber 60 of the first valve 16 through conduit 42 due to the displacement of air within the tank 44 caused by the entering fuel. In this instance, the fuel vapor is permitted to enter the canister 10 due to the fact that both the first and second valves 16, 18 are in the open position when the engine 36 is not running.

When the engine 36 is running, the first and second valves 16, 18 are in the closed position. In this manner, the fuel vapor disposed within the fuel tank 44 may expand if subjected to heat, thereby increasing the pressure in the tank 44. Once sufficient pressure is built up within the fuel tank 44, a sensor 90 disposed within the fuel tank 44, sends a signal to the engine controller 88 to open the first and second valves 16, 18. Upon receiving the signal from the sensor 90, the engine controller 88 will cause the first and second valve solenoids 76, 78 to actuate, thereby causing the plunger 56 to disengage the engagement surface 66. Once the plunger 56 is sufficiently disengaged from the shelf 54, the vapor, laden air stream will enter the first compartment 28 of the housing 20. This vapor can be drawn into the engine 36, or pass through the adsorbent material 39. The cleansed air stream will exit the housing 20 through the second valve 18 and be released into the atmosphere after passing through the filter arrangement 50.

As previously discussed, an adsorbent material including carbon pellets 39 retains the impurities from the fuel vapor. To remove the stored hydrocarbons from the adsorbent pellets 39, the purge solenoid 38 is activated, thereby causing the housing 20 to be placed under a vacuum pressure. The vacuum pressure generates an airflow that carries the stored hydrocarbons from the housing 20 to the engine 36. Specifically, as the air stream moves through the adsorbent pellets 39, the air stream becomes filled with fuel vapors, which may be reused in the combustion process of the engine 36. To deliver the fuel vapor to the engine 36, the purge solenoid 38 opens a path from the engine 36 to the canister 10 while concurrently opening a path to a manifold vacuum port 92, whereby the manifold port 92 is disposed generally proximate to the connection of the conduit 40 to the engine 36. The manifold port 92 allows the vapor laden air stream to enter the engine 36 via conduit 40, as best shown in FIG. 1. In this regard, the engine 36 imparts a vacuum pressure on the canister 10 via conduit 40.

It should be understood that when the purge solenoid 38 creates a vacuum within the housing 20, the first and second valves 16, 18 are in the closed position, thereby creating a negative pressure within the housing 20. The orifice 80 formed within the second valve 18 allows a predetermined ambient airflow to enter the housing 18 during the purging process, thereby improving the overall efficiency of the process by regulating the pressure within the housing 20 and allowing an airflow over the adsorbent pellets 39. By increasing the vacuum within the housing 20 during the purging process, more fuel vapor is released through interaction with the stored hydrocarbons, thereby providing the engine 36 with more hydrocarbons for use in the combustion process.

As previously discussed, the first and second valves 16, 18 are in the closed position when the canister 10 is purged. In this manner, the fuel vapor disposed within the fuel tank 44 will increase due to the generally confined space of the fuel tank 44 until the first valve 16 is opened and the pressure is relieved. To prevent damage to the fuel tank 44, the sensor 90 is operable to send a signal to the engine controller 88 and first valve solenoid 76 to open the first valve 16 if the pressure in the fuel tank 44 becomes higher than a predetermined amount. In this regard, the sensor 90 is operable to open the first and second valves 16, 18 and allow the pressurized fuel vapor to enter the housing 20, thereby alleviating the pressure within the tank 44.

Figure 2:
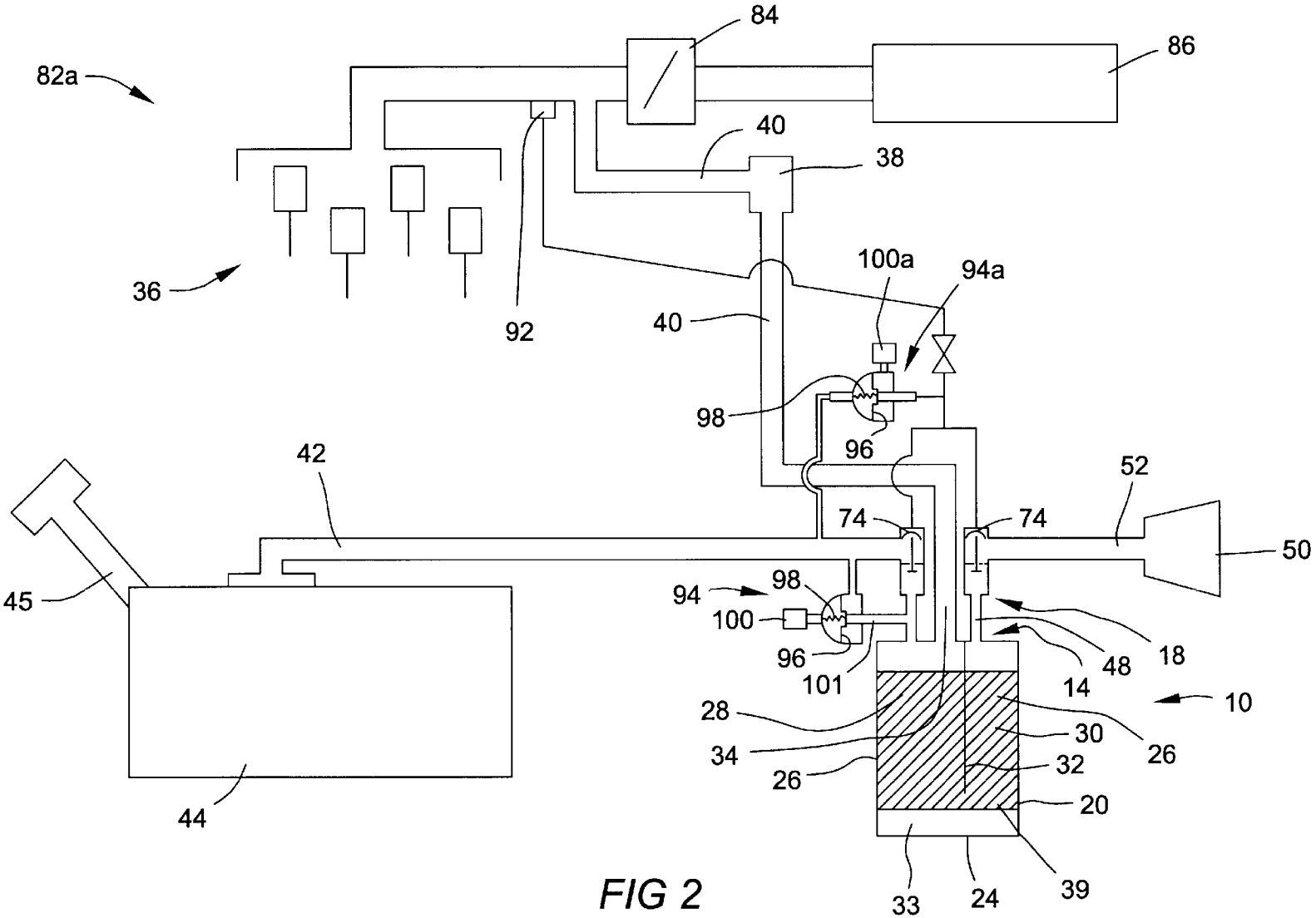
FIG. 2 is a schematic representation of a second embodiment of a fuel system having a vapor recovery canister in accordance with the principles of the present invention.

With reference to FIG. 2, the vapor recovery canister 10 is shown incorporated into a second embodiment of the fuel system 82*a*. The second fuel system 82*a* is substantially similar to the first fuel system 82 with the exception that the first and second valves 16, 18 are controlled by the engine vacuum directly. Specifically, the plungers 56 of the first and second valves 16, 18 are toggled into the closed position as the vacuum from the engine 36 acts on the diaphragms 74. In this manner, once there is sufficient pressure to move the plungers 56 against the bias of the diaphragms 74, the plungers 56 will abut the shelves 54 and close the first and second valves 16, 18 from the fuel tank 44 and filter 50, respectively.

The second fuel system 82*a* further includes a first pressure relief valve 94 in fluid communication with the first conduit 42 and the second chamber 62 of the first valve 16. With reference to FIG. 4, the first pressure relief valve 94 includes a diaphragm 96, a spring 98, and a filter 100. The diaphragm 96 is operable between an open position and a closed position, whereby the closed position prevents a vacuum pressure from reaching the fuel tank 44 when the canister 10 is under a vacuum pressure (i.e. during a purging cycle). Additionally, the diaphragm 96 allows an airflow to reach the second chamber 62 of the first valve 16 if a predetermined pressure is realized within the fuel tank 44, thereby ensuring that the tank 44 will not experience a high pressure condition when the first and second valves 16, 18 are in the closed position. The diaphragm 96 is biased into the closed position by the spring 98, whereby the diaphragm 96 is operable to selectively allow an airflow to enter the housing 20 via the second chamber 62 if a predetermined pressure reacts against the diaphragm 96 and spring 98.

In operation, the first pressure relief valve 94 essentially serves to protect the tank 44 from experiencing a high pressure condition when the first and second valves 16, 18 are in the closed position and further serves to protect the tank 44 from experiencing a high vacuum pressure when the canister 10 is being purged. Specifically, the spring 98 is constructed so that the diaphragm 96 will be in the closed position until a predetermined pressure reacts against the diaphragm 96, thereby compressing the spring 98 and allowing flow between the tank 44 and the second chamber 62 of the first valve 16. In this regard, the flow between the tank 44 and the canister 10 effectively reduces the pressure in the tank 44. The filter 100 is provided to ensure that the diaphragm 96 will return to the closed position once the air pressure from the tank 44 is released. The filter 100 allows an air stream, under ambient pressure, to enter the first pressure relief valve 94 to allow the spring 98 to close the diaphragm 96 while concurrently filtering the air stream to keep the valve 94 clean.

In the case of tank pressure, the pressure relief valve 94 will maintain the engagement between the diaphragm 96 and a conduit 101 to ensure that the vacuum pressure created during the purge cycle, within the housing 20, is not transmitted to the fuel tank 44 via conduit 42. The first pressure relief valve 94 essentially allows pressurized vapor flow from the tank 44 to the canister 10 but prevents vacuum exposure to the tank 44 from the canister 10 when the canister 10 is under a vacuum pressure. In this regard, the first pressure relief valve 94 allows the fuel tank 44 to maintain near ambient pressure when the first and second valves 16, 18 are in the closed position without requiring the use of a pressure relief sensor in the fuel tank 44.

A second relief valve 94*a* is also provided and serves to prevent the fuel tank 44 from experiencing an over vacuum condition when the first and second valves 16, 18 are it the closed position. In view of the substantial similarity in structure and function of the components associated With the first pressure relief valve 94 with respect to the second relief valve. 94*a*, like reference numerals are used hereinafter and in the drawings to identify like components while like reference numerals containing letter extensions are used to identify those components that have been modified.

The second relief valve 94*a* is a vacuum relief valve and includes a diaphragm 96, a spring 98, and a filter 100*a*. The second relief valve 94*a* is disposed between the manifold vacuum port 92 and the first and second valves 16, 18. Additionally, the second relief valve 94*a* is fluidly coupled to the fuel tank 44 via conduit 42, as best shown in FIG. 2. The second vacuum relief valve 94*a* essentially operates in a similar manner with respect to the first pressure relief valve 94, whereby the second relief valve 94*a* diverts vacuum from the first and second valves 16, 18 when the fuel tank 44 experiences a predetermined vacuum pressure. Specifically, when the first and second valves 16, 18 are in the closed position, the fuel tank 44 may experience a vacuum condition if the tank 44 is subjected to cold condition from a warm condition, whereby the second relief valve 94*a* is operable to divert this vacuum pressure away from the first and second valves 16, 18.

Once the diaphragm 96 allows ambient air pressure from the manifold vacuum port 92 to enter the second relief valve 94*a*, the vacuum pressure acting on the first and second valves 16, 18 will be relieved. Once the pressure is sufficiently relieved, the plungers 56 will fall into the open position. In this manner, the tank 44 will be allowed to draw an air stream from the canister 10 to alleviate the vacuum experienced by the tank 44. The filter 100*a* allows the first and second valves 16, 18 to toggle into the open position by allowing an ambient air stream into the system to release the vacuum pressure on the plungers 56. In addition, the filter 100*a* is designed to filter any impurities out of the ambient air stream to prevent impurities from entering the canister 10 when the second relief valve 94*a* is opened.

In either of the foregoing embodiments, the vacuum pressure within the housing 20 is increased when the first and second valves 16, 18 are in the closed position through the interaction between the engine vacuum and the orifice 80. Additionally, both embodiments provide the system with the ability to maintain the fuel tank 44 at a predetermined pressure to ensure that the tank 44 is not damaged by a significant pressure or vacuum exposure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A vapor recovery canister comprising:

a body defining an interior volume of the canister;

an inlet port fluidly coupled to said interior volume;

an outlet port fluidly coupled to said interior volume; and a first valve operable to selectively close said inlet port and a second valve operable to selectively close said outlet port, said second valve including at least one orifice formed therethrough for continuous fluid communication with an ambient air stream.

2. The vapor recovery canister of claim 1, wherein said inlet port is adapted to be fluidly connected to a fuel tank, said inlet port operable to receive an air stream from said fuel tank when said first valve is in an open state.

3. The vapor recovery canister of claim 1, wherein said outlet port is adapted to be fluidly connected to a filter, said filter operable to expel an air stream from the canister when said second valve is in an open state and filter an ambient air stream entering the canister.

4. The vapor recovery canister of claim 1, wherein said first and second valves include a shelf portion and a plunger portion, said plunger portion selectively engaging said shelf portion to close said valve.

5. The vapor recovery canister of claim 4, wherein said shelf portion of said second valve includes said orifice formed therethrough.

6. The vapor recovery canister of claim 4, wherein said plunger portion of said second valve includes said orifice formed therethrough.

7. The vapor recovery canister of claim 4, wherein said plunger includes a seal to interact with said shelf, said interaction between said seal and said shelf operable to close the valve.

8. The vapor recovery canister of claim 1, wherein said interior volume includes an adsorbent material operable to trap hydrocarbons from a vapor laden air stream.

9. The vapor recovery canister of claim 8, wherein the canister includes a purge port fluidly coupled to said interior volume, said purge port adapted to be fluidly connected to a vacuum source.

10. The vapor recovery canister of claim 9, wherein said purge port is fluidly connected to said orifice such that a vacuum generated by said vacuum source produces an ambient air stream flowing into the canister through said orifice and through said adsorbent material to said purge port.

11. An automotive fuel system comprising:

a fuel tank;

an outlet filter; and a vapor recovery canister fluidly connected to said fuel tank and said outlet filter, said vapor recovery canister including:

a body defining an interior volume of the canister;

an inlet port fluidly coupled to said interior volume and said fuel tank;

an outlet port fluidly coupled to said interior volume and said outlet filter; and a first and second valve, said first valve operable to selectively close said inlet port and said second valve operable to selectively close said outlet port, said second valve including at least one orifice formed therethrough for continuous fluid communication of said interior volume with said outlet filter.

12. The automotive fuel system of claim 11 further including a first and second solenoid valve operable to toggle said first and second valves between an open and closed position, respectively.

13. The automotive fuel system of claim 11 further including a purge solenoid operable to purge the contents of the vapor recovery canister.

14. The automotive fuel system of claim 13, wherein said purge solenoid is fluidly connected at a first end to the vapor recovery canister and fluidly connected at a second end to a vehicle engine.

15. The automotive fuel system of claim 14, wherein said purge solenoid is fluidly coupled to a purge port of said vehicle engine, said purge solenoid operable to close said first and second valves when said engine draws a vacuum pressure through said purge port.

16. The automotive fuel system of claim 15, wherein said fuel tank includes a pressure sensor, said pressure sensor operably connected to an engine controller, said engine controller operable to selectively open said first valve to release the pressure in said fuel tank.

17. The automotive fuel system of claim 11 further comprising an adsorbent material disposed within said interior volume to trap hydrocarbons in vapor from said fuel tank.

18. The automotive fuel system of claim 11 further comprising a pressure relief valve disposed between said fuel tank and the canister, said pressure relief valve operable to allow fluid flow into the canister when said first valve is in a closed position and said fuel tank is subjected to a predetermined pressure, and a vacuum relief valve operable to prevent a vacuum from being applied to said fuel tank when said canister is under a vacuum and said first valve is in said closed position.

19. The automotive fuel system of claim 11, wherein a sensor is operably connected to said engine controller, said sensor operable to send a signal to said engine controller to open said first and second valves when said fuel tank reaches a predetermined pressure.

20. A method of purging a vapor recovery canister comprising the steps of:

positioning a vapor recovery canister in fluid communication between a fuel tank and an outlet filter;

providing the canister with a first and second valve to selectively restrict fluid flow into the canister from said fuel tank and said outlet filter;

providing said second valve with an orifice, said orifice in continuous fluid communication with an ambient air stream;

placing the canister under a vacuum pressure to draw an ambient air stream into the canister through the orifice; and directing said air stream over an adsorbent material disposed within the canister to direct trapped hydrocarbons disposed within said adsorbent material to a vehicle engine for aid in a combustion process.

* * * * *